US008965758B2

(12) United States Patent
Chen et al.

(10) Patent No.: US 8,965,758 B2
(45) Date of Patent: Feb. 24, 2015

(54) AUDIO SIGNAL DE-NOISING UTILIZING INTER-FRAME CORRELATION TO RESTORE MISSING SPECTRAL COEFFICIENTS

(75) Inventors: Longyin Chen, Shenzhen (CN); Lei Miao, Beijing (CN); Chen Hu, Shenzhen (CN); Zexin Liu, Beijing (CN); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 783 days.

(21) Appl. No.: 13/248,725

(22) Filed: Sep. 29, 2011

(65) Prior Publication Data

US 2012/0022878 A1 Jan. 26, 2012

Related U.S. Application Data

(63) Continuation of application No. PCT/CN2009/076155, filed on Dec. 28, 2009.

(30) Foreign Application Priority Data

Mar. 31, 2009 (CN) ..... 2009 1 0133808

(51) Int. Cl.
*G10L 19/24* (2013.01)
*G10L 21/0264* (2013.01)
(Continued)

(52) U.S. Cl.
CPC ..... *G10L 21/0205* (2013.01); *G10L 19/24* (2013.01); *G10L 21/038* (2013.01)
USPC ..... 704/228; 704/226; 704/E21.011

(58) Field of Classification Search
CPC ..... G10L 19/18; G10L 19/24
USPC ..... 704/226, 228, 500, E21.011
See application file for complete search history.

(56) References Cited

U.S. PATENT DOCUMENTS 5,237,587 A 8/1993 Schoolcraft
5,940,435 A 8/1999 Hendrickson
(Continued)

FOREIGN PATENT DOCUMENTS

CN 1103222 A 5/1995
CN 1276896 A 12/2000
(Continued)

OTHER PUBLICATIONS

Kontio, et al. "Neural network-based artificial bandwidth expansion of speech." Audio, Speech, and Language Processing, IEEE Transactions on 15.3, Mar. 2007, pp. 873-881.*
(Continued)

*Primary Examiner* — James Wozniak
(74) *Attorney, Agent, or Firm* — Leydig, Voit & Mayer, Ltd.

(57) ABSTRACT

In the field of audio encoding/decoding technologies, a signal de-noising method is provided. The method includes: selecting, according to a degree of inter-frame correlation of a frame where a spectral coefficient to be adjusted resides, at least two spectral coefficients having high correlation with the spectral coefficient to be adjusted; performing weighting on the at least two selected spectral coefficients and the spectral coefficient to be adjusted to acquire a predicted value of the spectral coefficient to be adjusted; and adjusting a spectrum of a decoded signal by using the acquired predicted value, and outputting the adjusted decoded signal. A signal de-noising apparatus corresponding to the signal de-noising method and an audio decoding system using the signal de-noising apparatus are also provided.

14 Claims, 3 Drawing Sheets

(51) Int. Cl.
*G10L 21/02* (2013.01)
*G10L 21/038* (2013.01)

(56) References Cited

U.S. PATENT DOCUMENTS

| | | | | |
|---|---|---|---|---|
| 6,675,144 | B1 * | 1/2004 | Tucker et al. | 704/264 |
| 6,931,373 | B1 * | 8/2005 | Bhaskar et al. | 704/230 |
| 7,466,245 | B2 | 12/2008 | Unno | |
| 7,539,613 | B2 * | 5/2009 | Takada | 704/205 |
| 8,078,474 | B2 * | 12/2011 | Vos et al. | 704/500 |
| 2002/0174493 | A1 | 11/2002 | Perry et al. | |
| 2003/0128851 | A1 | 7/2003 | Furuta | |
| 2003/0233234 | A1 * | 12/2003 | Truman et al. | 704/256 |
| 2004/0176961 | A1 | 9/2004 | Manu et al. | |
| 2006/0031075 | A1 * | 2/2006 | Oh et al. | 704/500 |
| 2006/0271362 | A1 | 11/2006 | Katou et al. | |
| 2008/0015855 | A1 | 1/2008 | Suzuki | |
| 2008/0106445 | A1 * | 5/2008 | Unno | 341/60 |
| 2009/0119111 | A1 * | 5/2009 | Goto et al. | 704/500 |
| 2010/0094629 | A1 * | 4/2010 | Emori et al. | 704/244 |
| 2010/0324892 | A1 | 12/2010 | Yasunaga et al. | |
| 2013/0218577 | A1 * | 8/2013 | Taleb et al. | 704/500 |

FOREIGN PATENT DOCUMENTS

| | | | |
|---|---|---|---|
| CN | 1463422 | A | 12/2003 |
| CN | 1495706 | A | 5/2004 |
| CN | 1892822 | A | 1/2007 |
| CN | 101010727 | A | 8/2007 |
| CN | 101046964 | A | 10/2007 |
| CN | 101067650 | A | 11/2007 |
| CN | 101369424 | A | 2/2009 |
| EP | 1441330 | A2 | 7/2004 |
| EP | 1903558 | A2 | 7/2007 |
| JP | 60014544 | A | 1/1985 |
| JP | 09-261065 | | 10/1997 |
| JP | 10020011 | A | 1/1998 |
| JP | 10049200 | A | 2/1998 |
| JP | 2004206129 | A | 7/2004 |
| KR | 100843522 | B1 | 7/2008 |
| KR | 101143792 | B1 | 5/2012 |
| WO | WO 2006062202 | A1 | 6/2006 |
| WO | WO 2007/099222 | A | 9/2007 |

OTHER PUBLICATIONS

International Search Report in corresponding PCT Application No. PCT/CN2009/076155 (Apr. 1, 2010).

1st Office Action in corresponding Japanese Patent Application No. 2012-502425 (Feb. 26, 2013).

Written Opinion of the International Searching Authority in corresponding PCT Application No. PCT/CN2009/076155 (Apr. 1, 2010).

"G.711.1—Wideband embedded extension for G.711 PCM: New Annex D with superwideband extension Amendment 4," Series G: Transmission Systems and Media, Digital Systems and Networks Digital terminal equipments—Coding of voice and audio signals, Nov. 2010, International Telecommunication Union, Geneva, Switzerland.

"G.722-7 kHz audio-coding within 64 kbit/s, Amendment 1: New Annex B with superwideband embedded extension," Series G: Transmission Systems and Media, Digital Systems and Networks, Digital terminal equipments—Coding of voice and audio signals, Nov. 2010, International Telecommunication Union, Geneva, Switzerland.

1st Office Action in corresponding Korean Patent Application No. 10-2011-7024686 (Apr. 16, 2013).

Extended European Search Report in corresponding European Patent Application No. 12190501.2 (Dec. 13, 2012).

* cited by examiner

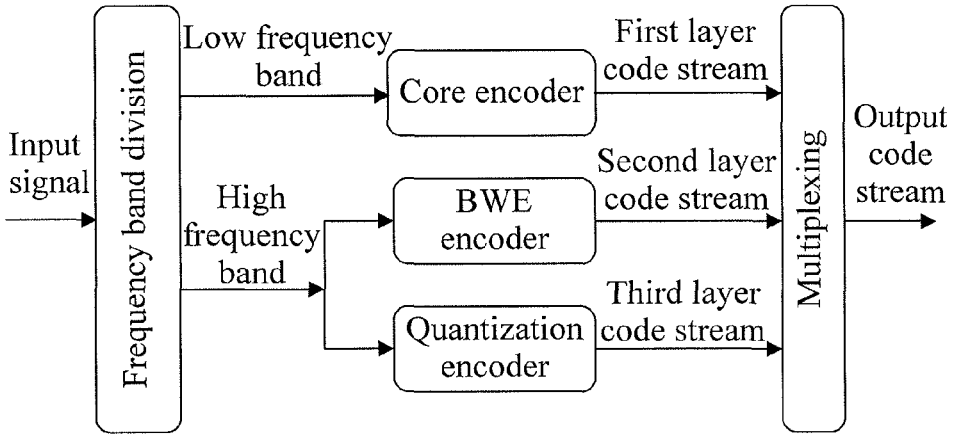
FIG. 1 (RelatedPrior Art)
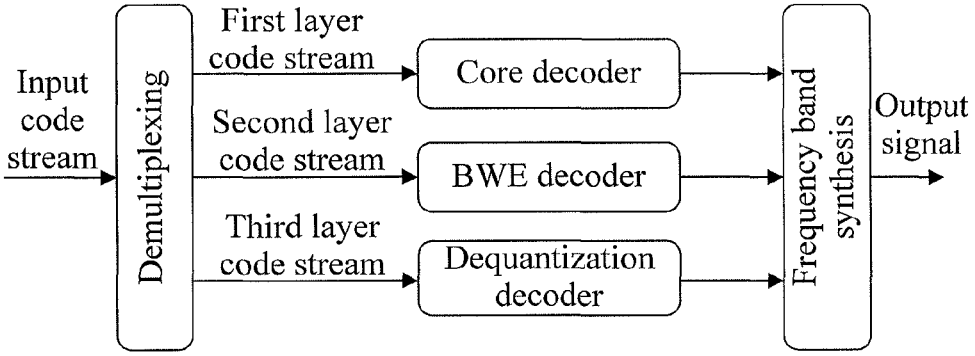
FIG. 2 (Related Prior Art)
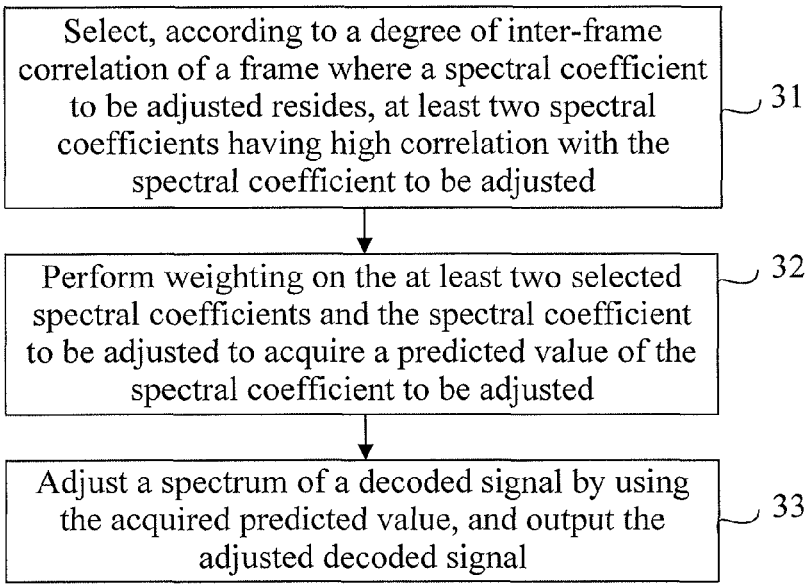
FIG. 3

AUDIO SIGNAL DE-NOISING UTILIZING INTER-FRAME CORRELATION TO RESTORE MISSING SPECTRAL COEFFICIENTS

CROSS-REFERENCE TO RELATED APPLICATIONS

This application is a continuation of International Application No. PCT/CN2009/076155, filed on Dec. 28, 2009, which claims priority to Chinese Patent Application No. 200910133808.6, filed on Mar. 31, 2009, both of which are hereby incorporated by reference in their entireties.

FIELD OF THE INVENTION

The present invention relates to the field of audio encoding/decoding technologies, and in particular, to a signal de-noising method, a signal de-noising apparatus, and an audio decoding system.

BACKGROUND OF THE INVENTION

In many broadband or ultra-broadband audio codecs, when a code rate is low, Band Width Extension (BWE) parameter encoding is used for spectra in a broadband portion or an ultra-broadband portion, where the BWE parameter encoding is characterized in that a few bits are used, the bandwidth is ensured, and the quality is acceptable; and when the code rate is high, quantization encoding is performed on the spectra in the broadband or ultra-broadband portion, where the quantization encoding is characterized in that, many bits are used, the precision is high, and the quality is good.

For structure diagrams of an audio encoding/decoding system supporting broadband or ultra-broadband in the prior art, reference may be made to FIG. 1 and FIG. 2. FIG. 1 is a structure diagram of an audio encoding system supporting broadband or ultra-broadband in the prior art. As shown in FIG. 1, the encoding system adopts a layered structure. A core encoder encodes low-frequency information, so as to output a first layer code stream. A BWE encoder encodes a high-frequency band spectrum by using a few bits, so as to output a second layer code stream. A quantization encoder quantizes and encodes the high-frequency band spectrum by using remaining bits, so as to output a third layer code stream.

FIG. 2 is a structure diagram of an audio decoding system supporting broadband or ultra-broadband in the prior art. As shown in FIG. 2, the decoding system also adopts a layered structure. A core decoder is configured to decode the low-frequency information of the first layer code stream. A BWE decoder is configured to decode BWE information of the second layer code stream. A dequantization decoder is configured to decode and dequantize high-frequency band information of the third layer code stream of the remaining bits. Finally, the decoding system synthesizes the frequency bands of the three layers of code streams to output a band-synthesized audio signal. Generally, the signal output by the core decoder is a time-domain signal, and signals output by the BWE decoder and the dequantization decoder are frequency-domain signals, so the frequency-domain signals of the second and third layer code streams are converted into the time-domain signals when the frequency bands are synthesized, so as to output a band-synthesized time-domain audio signal.

In the process of decoding, for a high-frequency band spectral signal, when the code rate is low, the decoding system can only decode the second layer code stream, so as to obtain BWE-encoded information, thereby ensuring basic high-frequency band quality; and when the code rate is high, the decoding system can further decode the third layer code stream to obtain better high-frequency band quality.

In this layered structure, in many cases, because bits of the third layer code stream reserved for the spectral quantization encoding are insufficient, the quantizer performs bit allocation. The quantizer allocates many bits to some important frequency bands to perform high precision quantization, while allocates a few bits to some less important frequency bands to perform low precision quantization, and even allocates no bit to some least important frequency bands. That is, the quantizer does not quantize the least important frequency bands.

In the prior art, several processing methods are performed on spectra of the unquantized frequency bands: 1. Retain a BWE spectrum; 2. Copy a part of spectra obtained through dequantization, adjust energy of the part of spectra, and then fill the part of spectra in the unquantized frequency bands; and 3. Set the unquantized spectra to 0, or directly fill the unquantized spectra with noise.

During implementation of the present invention, the inventors find that the prior art causes obvious noise and a bad acoustic effect because of one or more of the following reasons.

1. If the BWE spectra are retained on the spectra of the unquantized frequency bands, the quantized spectra and the BWE spectra retained on the spectra of the unquantized frequency bands are mismatched for position information and/or energy information, thereby introducing noise. 2. If a lot of spectra are unquantized and set to 0 or filled with noise, noise is directly introduced to the spectra of the unquantized frequency bands. Noise is introduced during frequency band synthesis after decoding because of the mismatching or the zero setting and noise filling, thereby deteriorating the acoustic effect of the audio signal.

SUMMARY OF THE INVENTION

Embodiments of the present invention provide a signal de-noising method, a signal de-noising apparatus, and an audio decoding system, which can reduce noise generated by frequency band synthesis after decoding and improve an acoustic effect.

Specifically, an embodiment of the present invention provides a signal de-noising method, which includes:

selecting, according to a degree of inter-frame correlation of a frame where a spectral coefficient to be adjusted resides, at least two spectral coefficients having high correlation with the spectral coefficient to be adjusted;

performing weighting on the at least two selected spectral coefficients and the spectral coefficient to be adjusted to acquire a predicted value of the spectral coefficient to be adjusted; and adjusting a spectrum of a decoded signal by using the acquired predicted value, and outputting the adjusted decoded signal.

An embodiment of the present invention provides a signal de-noising apparatus, which includes:

a selection unit, configured to select, according to a degree of inter-frame correlation of a frame where a spectral coefficient to be adjusted resides, at least two spectral coefficients having high correlation with the spectral coefficient to be adjusted;

a weighting unit, configured to perform weighting on the at least two spectral coefficients selected by the selection unit and the spectral coefficient to be adjusted to acquire a predicted value of the spectral coefficient to be adjusted; and an adjustment and output unit, configured to adjust a spectrum of a decoded signal by using the predicted value acquired by the weighting unit and output the adjusted decoded signal.

An embodiment of the present invention provides an audio decoding system, which includes a core decoder, a BWE decoder, a dequantization decoder, and the signal de-noising apparatus, where the core decoder is configured to decode low-frequency information of a first layer code stream;

the BWE decoder is configured to decode BWE information of a second layer code stream;

the dequantization decoder is configured to decode and dequantize high-frequency band information of a third layer code stream of remaining bits; and the signal de-noising apparatus is configured to receive the decoded information output by the BWE decoder and the dequantization decoder, determine a spectral coefficient to be adjusted in the decoded information, and adjust a spectral coefficient in the decoded information according to an acquired predicted value of the spectral coefficient to be adjusted.

It can be known from the technical solutions according to the embodiments of the present invention that, the spectral coefficient to be adjusted is weighted with the at least two relevant spectral coefficients to acquire the predicted value of the spectral coefficient to be adjusted, and the spectrum of the decoded signal is adjusted according to the spectral coefficient to be adjusted, so that the predicted spectral coefficient (that is, the predicted value of the spectral coefficient to be adjusted) and other relevant spectral coefficients are adaptable to one another, and therefore the spectral coefficients obtained according to different quantization precision are adaptable to one another, thereby increasing smoothness of the spectrum of the decoded signal, reducing noise generated by frequency band synthesis after decoding, and enabling a band-synthesized audio signal to achieve a better acoustic effect.

BRIEF DESCRIPTION OF THE DRAWINGS

To illustrate the technical solutions according to the embodiments of the present invention or in the prior art more clearly, the accompanying drawings required for describing the embodiments or the prior art are introduced below briefly. Apparently, the accompanying drawings in the following descriptions show merely some of the embodiments of the present invention, and persons skilled in the art can obtain other drawings according to the accompanying drawings without creative efforts.

FIG. 1 is a structure diagram of an existing audio encoding system;

FIG. 2 is a structure diagram of an existing audio decoding system;

FIG. 3 is a schematic flow chart of a signal de-noising method according to Embodiment 1 of the present invention;

DETAILED DESCRIPTION OF THE EMBODIMENTS

The technical solutions of the embodiments of the present invention are clearly described in the following with reference to the accompanying drawings. It is obvious that the embodiments to be described are only a part rather than all of the embodiments of the present invention. All other embodiments obtained by persons skilled in the art based on the embodiments of the present invention without creative efforts shall fall within the protection scope of the present invention.

Embodiment 1

Referring to FIG. 3, an embodiment of the present invention provides a signal de-noising method. The method includes the following steps:

Step 31: Select, according to a degree of inter-frame correlation of a frame where a spectral coefficient to be adjusted resides, at least two spectral coefficients having high correlation with the spectral coefficient to be adjusted.

Step 32: Perform weighting on the at least two selected spectral coefficients and the spectral coefficient to be adjusted to acquire a predicted value of the spectral coefficient to be adjusted.

Step 33: Adjust a spectrum of a decoded signal by using the acquired predicted value, and output the adjusted decoded signal.

In the signal de-noising method according to the embodiment of the present invention, the spectral coefficient to be adjusted is weighted with the at least two relevant spectral coefficients to acquire the predicted value of the spectral coefficient to be adjusted, and the spectrum of the decoded signal is adjusted according to the predicted value of the spectral coefficient to be adjusted, so that the predicted spectral coefficient (that is, the predicted value of the spectral coefficient to be adjusted) and other relevant spectral coefficients are adaptable to one another, and therefore the spectral coefficients obtained according to different quantization precision are adaptable to one another, thereby increasing smoothness of the spectrum of the decoded signal, reducing noise generated by frequency band synthesis after decoding, and enabling a band-synthesized audio signal to achieve a better acoustic effect.

Embodiment 2

Figure 4:
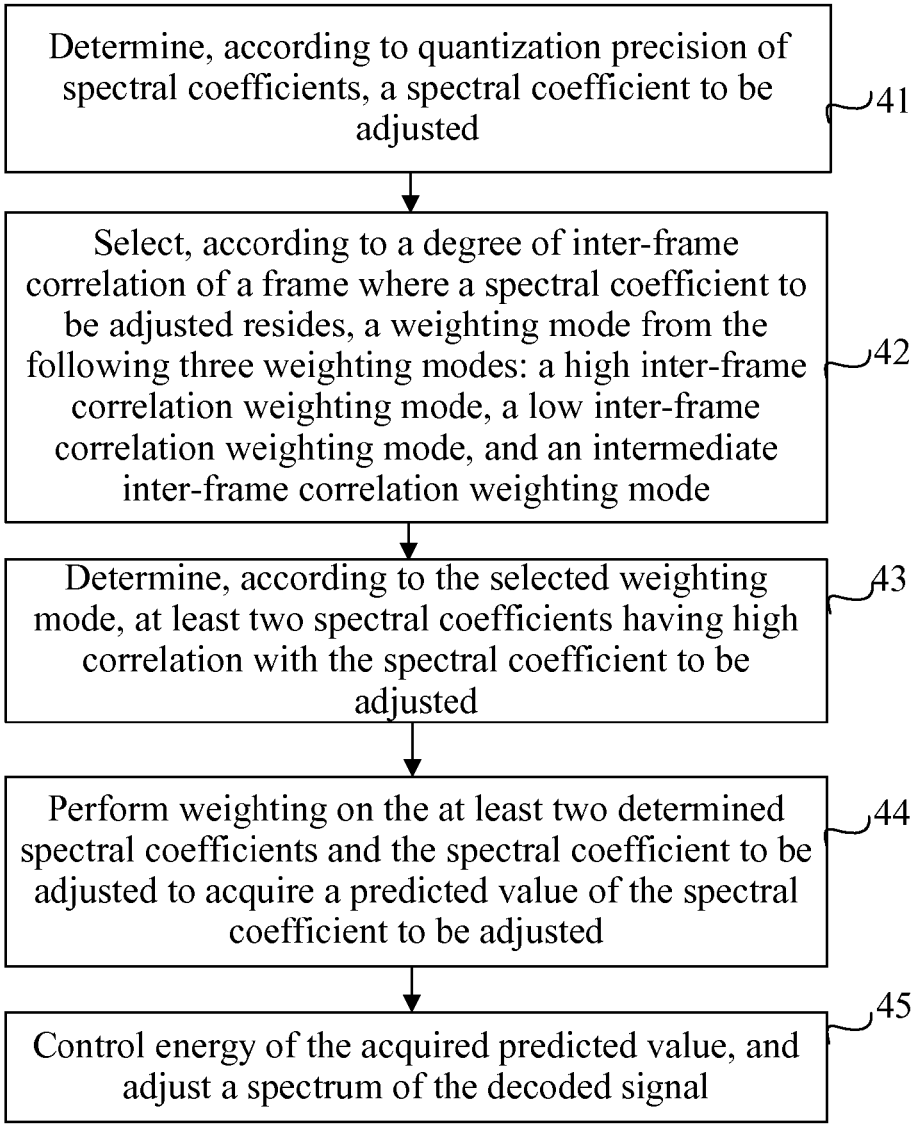
FIG. 4 is a schematic flow chart of a signal de-noising method according to Embodiment 2 of the present invention.

Referring to FIG. 4, an embodiment of the present invention provides a signal de-noising method. The method includes the following steps:

Step 41: Determine a spectral coefficient to be adjusted in a decoded signal according to quantization precision of spectral coefficients.

At a decoding end, a core decoder, a BWE decoder, and a dequantization decoder each decode a received encoded signal and then output a decoded signal. The decoded signal is formed of a low-frequency signal output by the core decoder, a BWE high-frequency signal output by the BWE decoder, and other high-frequency signals output by the dequantization decoder. The BWE high-frequency signal output by the BWE decoder and other high-frequency signals output by the dequantization decoder are frequency-domain signals. The determined spectral coefficient to be adjusted may include an unquantized spectral coefficient and/or a spectral coefficient having quantization precision lower than a quantization precision threshold. Herein, the quantization precision threshold may be set according to requirements.

For example, for scalar quantization, if the smallest bit rate of the decoded signal is 1 bit/frequency sample, when one frequency sample corresponds to a spectral coefficient of one bit only (that is, a bit rate of the frequency sample is 1 bit/frequency sample), where one bit can denote only sign information of the frequency sample, and no bit position (that is, zero bit) denotes amplitude information of the frequency sample, so the frequency sample having the bit rate of 1 bit/frequency sample does not have the amplitude information (it can be considered that quantization precision of the frequency sample is 0), and the frequency sample is unquantized, it therefore can be determined that the frequency sample having the bit rate of 1 bit/frequency sample is a frequency sample to be adjusted. For vector quantization, average quantization precision of a vector having the frequency sample may be first determined. If the quantization precision is less than a lower limit threshold, for example, 0.5 bit/frequency sample, it is determined that all frequency samples in the vector need to be adjusted. If the average quantization precision is greater than an upper limit threshold, for example, 2 bits/frequency sample, it is determined that no frequency sample in the vector needs to be adjusted. If the average quantization precision is between the lower limit threshold and the upper limit threshold, for example, between 0.5 bit/frequency sample and 2 bits/frequency sample, it is further determined whether there are frequency samples in the vector that are not vector-quantized; if there are such frequency samples in the vector, it is determined that the frequency samples not vector-quantized need to be adjusted; and if there are no such frequency samples in the vector, no frequency sample needs to be adjusted.

Step 42: Select, according to a degree of inter-frame correlation of a frame where a spectral coefficient to be adjusted resides, one weighting mode from the three weighting modes: a high inter-frame correlation weighting mode, a low inter-frame correlation weighting mode, and an intermediate inter-frame correlation weighting mode.

The degree of the inter-frame correlation can be judged according to a parameter related to the correlation, for example, a BWE algorithm. The algorithm uses a frame type to denote the degree of the inter-frame correlation. A frame of a transient type indicates that the inter-frame correlation is low; a frame of a harmonic type indicates that the inter-frame correlation is high; and a frame of a normal type indicates that the inter-frame correlation is intermediate. In the BWE algorithm, the frame type is a parameter related to the correlation. The degree of the inter-frame correlation can be determined according to the frame type, and therefore a weighting mode is determined.

Definitely, the degree of the inter-frame correlation may also be determined through calculation. For example, correlation between the frame where the spectral coefficient to be adjusted resides and an adjacent frame is first calculated by using a correlation calculation method. If the correlation is greater than an upper limit threshold, the inter-frame correlation of the frame where the spectral coefficient to be adjusted resides is high. If the correlation is less than a lower limit threshold, the inter-frame correlation of the frame where the spectral coefficient to be adjusted resides is low. In other situations, for example, if the correlation is between the upper limit threshold and the lower limit threshold, the inter-frame correlation of the frame where the spectral coefficient to be adjusted resides is intermediate.

In step 42, different weighting modes are selected according to the degree of the inter-frame correlation. When the inter-frame correlation is high, the high inter-frame correlation weighting mode is selected. When the inter-frame correlation is low, the low inter-frame correlation weighting mode is selected. When the inter-frame correlation is intermediate, the intermediate inter-frame correlation weighting mode is selected. Different weighting modes correspond to different weights and are used to weight inter-frame spectral coefficients and intra-frame spectral coefficients. Generally, the higher an inter-frame correlation is, the higher the weight of the inter-frame spectral coefficient is, and the lower the weight of an intra-frame spectral coefficient is; the lower the inter-frame correlation is, the lower the weight of an inter-frame spectral coefficient is, and the higher the weight of the intra-frame spectral coefficient is.

That is, the weight of an inter-frame spectral coefficient is directly proportional to the inter-frame correlation, and the weight of an intra-frame spectrum information is inversely proportional to the inter-frame correlation. For a frame having high inter-frame correlation, the weight of the inter-frame spectral coefficient is large, and the weight of the intra-frame spectral coefficient is small or set to zero. For a frame having low inter-frame correlation, the weight of the intra-frame spectral coefficient is large, and the weight of the inter-frame spectral coefficient is small or set to zero. For a frame having intermediate inter-frame correlation, magnitude of the weights of the intra-frame spectral coefficient and the inter-frame spectral coefficient may be determined by comparing the degrees of the inter-frame correlation and intra-frame correlation.

Step 43: Determine, according to the selected weighting mode, at least two spectral coefficients having high correlation with the spectral coefficient to be adjusted.

When a weighting mode is selected in step 42, the determining, according to the weighting mode, the at least two spectral coefficients having the high correlation with the spectral coefficient to be adjusted may be as follows: When the high inter-frame correlation weighting mode is selected, which indicates that the inter-frame correlation is high, at least two spectral coefficients may be determined in a frame adjacent to the frame where the spectral coefficient to be adjusted resides. When the low inter-frame correlation weighting mode is selected, which indicates that the inter-frame correlation is low, at least two spectral coefficients may be determined in the frame where the spectral coefficient to be adjusted resides. When the intermediate inter-frame correlation weighting mode is selected, which indicates that the inter-frame correlation is intermediate, at least two spectral coefficients may be determined both in the frame where the spectral coefficient to be adjusted resides and in the frame adjacent to the frame where the spectral coefficient to be adjusted resides.

Step 44: Perform weighting on the at least two determined spectral coefficients and the spectral coefficient to be adjusted to acquire a predicted value of the spectral coefficient to be adjusted.

The method for performing the weighting on the at least two determined spectral coefficients and the spectral coefficient to be adjusted may be that prediction may be performed by using a weighting value of at least one type of the following information: 1. a quantized spectral coefficient output by the dequantization decoder; 2. a BWE spectral coefficient output by the BWE decoder; and 3. an existing predicted value of the spectral coefficient obtained through prediction. A product of a spectral coefficient and a weight corresponding to the spectral coefficient is a weighting value of the spectral coefficient. The spectral coefficient to be adjusted may be a spectral coefficient corresponding to an unquantized frequency sample, so when the weighting is performed on the at least two spectral coefficients and the spectral coefficient to be adjusted in step 44, a weighting value of the spectral coefficient to be adjusted may be 0, that is, only weighting values of the at least two determined spectral coefficients are adopted to acquire the predicted value of the spectral coefficient to be adjusted.

Specifically, for the high inter-frame correlation weighting mode, the spectral coefficient is predicted according to a weighting value of at least one type of the following information: (1) a predicted value of a former frame; (2) a quantized spectral coefficient of the former frame; and (3) a BWE spectral coefficient of the former frame.

For the low inter-frame correlation weighting mode, the spectral coefficient is predicted according to a weighting value of at least one type of the following information: (1) a quantized spectral coefficient of a current frame; (2) a BWE spectral coefficient of the current frame; and (3) an existing predicted value of the current frame.

For the intermediate inter-frame correlation weighting mode, the spectral coefficient is predicted according to a weighting value of at least one type of the following information: (1) the existing predicted value of the former frame or the current frame; (2) the quantized spectral coefficient of the former frame or the current frame; and (3) the BWE spectral coefficient of the former frame or the current frame.

It should be noted that, the weight of each type of spectrum information may also be accordingly adjusted according to quantization precision of the frequency sample to be adjusted. During weighting prediction, if the spectral coefficient to be adjusted has a quantization result, the weighting prediction still can be performed on the quantization result, and the weight is directly proportional to the quantization precision of the spectral coefficient.

Step 45: Control energy of the acquired predicted value, and adjust a spectrum of the decoded signal.

In this step, an upper limit threshold of energy of the spectral coefficient to be adjusted is first determined, and then energy of the adjusted spectral coefficient is controlled to be in a range less than or equal to the upper limit threshold. The upper limit threshold may be determined according to a quantization error or a minimum nonzero quantization value in a range of the spectral coefficient to be adjusted, where the quantization error or the minimum nonzero quantization value may be obtained through the prior art, and details are not described herein again.

The controlling the energy of the acquired predicted value and adjusting the spectrum of the decoded signal may be: modifying, according to the upper limit threshold, the predicted value of the spectral coefficient to be adjusted to acquire a modification value of the spectral coefficient to be adjusted, where energy of the modification value is in a range less than or equal to the upper limit threshold; and adjusting the spectrum of the decoded signal by using the modification value, where when the predicted value is less than or equal to the upper limit threshold, the modification value is equal to the predicted value, and when the predicted value is greater than the upper limit threshold, the modification value is equal to the upper limit threshold.

Specifically, if the energy of the spectral coefficient of the frequency sample after prediction is greater than the upper limit threshold of the energy of the spectral coefficient to be adjusted, quantization error magnitude min_D or a minimum quantization value min_Q (a minimum amplitude value in the quantized spectral coefficient excluding a zero point) of the frequency sample is extracted (or estimated) as the upper limit threshold thr, and a threshold coefficient a ($a<=1$) is determined according to actual situations. If the energy of the predicted value of the spectral coefficient to be adjusted is greater than a×thr, the energy of the predicted value is adjusted to be less than or equal to a×thr. Herein, the threshold coefficient a may be determined by using an empirical value obtained according to experiment statistics, or magnitude of a may also be controlled according to the quantization precision.

The lower the quantization precision is, the larger the value of the threshold coefficient a is. When the quantization precision is higher than a frequency sample, the value of the threshold coefficient a is controlled to be a value from 1 to a numerical value less than 1. For example, when the quantization precision is higher than 1.5 bits/frequency sample, thr=min_D and a=0.7 are set; when quantization precision is lower than 0.5 bit/frequency sample, thr=min_Q and a=1 are set; and when quantization precision is higher than 0.5 bit/frequency sample and lower than 1.5 bits/frequency sample, thr=min_D and a=1 are set.

In the signal de-noising method according to the embodiment of the present invention, the spectral coefficient to be adjusted is determined according to the quantization precision of the spectral coefficient, different weighting modes are selected according to a degree of the inter-frame correlation of the frame where the spectral coefficient to be adjusted resides, the at least two spectral coefficients having the high correlation with the spectral coefficient to be adjusted are determined according to a selected weighting mode, the spectral coefficient to be adjusted is weighted to acquire the predicted value of the spectral coefficient to be adjusted, the energy of the acquired predicted value is controlled, and the spectrum of the decoded signal is adjusted, so that the predicted spectral coefficient (that is, the predicted value of the spectral coefficient to be adjusted) and other relevant spectral coefficients are adaptable to one another, and therefore the spectral coefficients obtained according to different quantization precision are adaptable to one another, thereby increasing smoothness of the spectrum of the decoded signal, reducing noise generated by frequency band synthesis after decoding, and enabling a band-synthesized audio signal to achieve a better acoustic effect.

Embodiment 3

This embodiment provides a method for performing weighting prediction on a spectral coefficient to be adjusted and describes spectrum information applicable in different weighting modes. The spectrum information includes the following information.

It is assumed that, intra-frame spectrum information is f_inner[n], an intra-frame weight is w_inner[n], inter-frame spectrum information is f_inter[n], and an inter-frame weight is w_inter[n], where $0<n<N$, and N is the maximum number of frequency samples included in a frame. If a spectral coefficient of a frequency sample n is the spectral coefficient to be adjusted, a predicted value f[n] of the spectral coefficient of the frequency sample n is expressed as Formula 1:

$$f[n]=w_inner[0]\times f_inner[0]+w_inner[1]\times f_inner[1]+\ldots+w_inner[N]\times f_inner[N]+w_inter[0]\times f_inter[0]+w_inter[1]\times f_inter[1]+\ldots+w_inter[N]\times f_inter[N] \quad \text{Formula 1}$$

The intra-frame weight w_inner[n] is directly proportional to intra-frame correlation. The inter-frame weight w_inter[n] is directly proportional to inter-frame correlation. A sum of all weights is 1.

How to perform the weighting prediction on the spectral coefficient to be adjusted is described through a specific example in the following.

It is assumed that, a quantized spectral coefficient fQ[n] of the frequency sample n in a current frame is determined as the spectral coefficient to be adjusted, a BWE spectral coefficient of the frequency sample n in a current frame is fB[n], a quantized spectral coefficient of the frequency sample n in a frame previous to the current frame is denoted as fS[1][n], a quantized spectral coefficient of the frequency sample n in a frame previous to the previous frame is denoted as fS[0][n], and a predication of the quantized spectral coefficient of the frequency sample n in the current frame is f[n]. Both the spectral coefficient and the predicted value may be zero or nonzero. When fQ[n] is zero, it indicates that the frequency sample n is unquantized.

If it is determined, according to step 41 in Embodiment 2, that a frequency sample 17 needs to be adjusted and different weighting modes are selected for a frame having the frequency sample according to step 42, the following processing may be performed for different weighting modes, where a frequency sample 16 and a frequency sample 18 are adjacent frequency samples of the frequency sample 17.

A. For a low inter-frame correlation weighting mode

If fQ[17] is unquantized, f[17]=(fB[17]+fQ[16]+fQ[18])/3. In this case, fB[17], fQ[16], and fQ[18] are spectral coefficients having high correlation with the spectral coefficient to be adjusted, weights of B[17], fQ[16], and fQ[18] are ⅓, ⅓, and ⅓ respectively. The meaning of the following other weighting prediction formulas is similar thereto and details are not described herein again.

If quantization precision of fQ[17] is very low, f[17]=(0.4×fB[17]+fQ[17]+0.8×fQ[16]+0.8×fQ[18])/3.

B. For a high inter-frame correlation weighting mode

If fQ[17] is unquantized, f[17]=(fS[0][17]+fS[1][17])/2.

If the quantization precision of fQ[17] is very low, f[17]=(0.3×fS[0][17]+0.7×fS[1][17]+fQ[17])/2.

C. For an intermediate inter-frame correlation weighting mode

If fQ[17] is unquantized, f[17]=(fB[17]+fQ[16]+fQ[18]+fS[1][16]+fS[1][17]+fS[1][18])/6.

If the quantization precision of fQ[17] is very low, f[17]=(2.5×fB[17]+fQ[16]+fQ[18]+0.5×fS[1][16]+0.5×fS[1][17]+0.5×fS[1][18])/6.

The weight and a range of the valued frequency sample in the foregoing example both come from an experiment result, that is, an empirical value. In actual applications in different scenarios, the weight and the valued frequency sample are differently selected due to different scenarios. For example, different core encoders have different BWE ranges. Therefore, a value range of the inter-frame spectrum information and the intra-frame spectrum information and a specific numerical value of the weight may be determined according to experiments in different scenarios.

In the method for performing the weighting prediction on the spectral coefficient to be adjusted according to Embodiment 3, the specific weights, spectral coefficients, and calculation formulas are adopted for description. The specific weights, spectral coefficients, and calculation formulas are only better implementation obtained according to the empirical values and do not limit the protection scope of the present invention. In practice, the specific weights, spectral coefficients, and calculation formulas can be flexibly adjusted according to specific situations, which are expansion and variation without departing from the present invention and fall within the protection scope of the present invention. The method for performing the weighting prediction on the spectral coefficient to be adjusted according to Embodiment 3 may be applicable to the embodiments of the present invention, so as to perform the weighting prediction on the spectral coefficient to be adjusted and acquire the predicted value of the spectral coefficient to be adjusted.

In another embodiment of the present invention, a signal de-noising method is provided. Herein, adaptation of a BWE algorithm to eight-dimensional grid-shaped vector quantization is taken as an example for description, but the present invention is not limited thereto, and the method according to the embodiment of the present invention may also be applicable to other vector quantization, such as four-dimensional quantization.

First, an upper limit threshold thr[i] of amplitude of a spectral coefficient to be adjusted in an eight-dimensional vector is calculated, where i denotes the $i^{th}$ eight-dimensional vector. If the $i^{th}$ eight-dimensional vector is an all-zero vector, thr[i] equals a value obtained by multiplying a weight by a frequency-domain envelope value of a frequency band. The frequency-domain envelope value may be a weighted sum or a weighted average value of amplitude values of two or more successive frequency-domain coefficients. The weighting coefficient may be calculated according to a window function or other arithmetic formulas. If the $i^{th}$ eight-dimensional vector is not the all-zero vector, thr[i] equals a value obtained by multiplying a weight by a minimum nonzero quantization value in the vector. Herein, the two weights may be empirical values obtained through experiments.

For convenience of description, the frame where the spectral coefficient to be adjusted resides is called a current frame.

If both the current frame and a previous frame of the frame are harmonic frames, the current frame has high inter-frame correlation. When a spectral coefficient of a vector of the previous frame is decoded and no spectral coefficient of a vector of a corresponding frequency band of the current frame is decoded, a method for restoring the spectral coefficient to be adjusted may be as follows: If amplitude of a quantized spectral coefficient of a frame previous to the previous frame is given times (for example, twice) greater than amplitude of a quantized spectral coefficient corresponding to the previous frame, the amplitude of the spectral coefficient to be adjusted is a weighted sum of amplitude of a BWE spectral coefficient of the current frame and the amplitude of the quantized spectral coefficient corresponding to the previous frame, and a sign of the spectral coefficient to be adjusted is a sign of the BWE spectral coefficient of the current frame. Otherwise, that is, if the amplitude of the quantized spectral coefficient corresponding to the frame previous to the previous frame is not given times greater than the amplitude of the quantized spectral coefficient corresponding to the previous frame, the amplitude of the spectral coefficient to be adjusted is a weighted sum of the amplitude of the quantized spectral coefficient corresponding to the frame previous to the previous frame, and the amplitude of the quantized spectral coefficient corresponding to the previous frame, the amplitude of the BWE spectral coefficient of the current frame, and the sign of the spectral coefficient to be adjusted is the sign of the BWE spectral coefficient of the current frame.

If the current frame or the previous frame is a transient frame, the current frame has low inter-frame correlation. If a spectral coefficient of a frequency sample is not decoded, a method for restoring the spectral coefficient to be adjusted of the frequency sample may be as follows: A weighted average value En of amplitude of a BWE spectral coefficient of a current frequency sample and amplitude of a quantized spectral coefficient of an adjacent frequency sample is calculated as the amplitude of the spectral coefficient to be adjusted. Herein, the current frequency sample is a frequency sample having the spectral coefficient to be adjusted and may be called a frequency sample to be adjusted. The adjacent frequency sample may be a frequency sample in the same frame having a frequency higher or lower than that of the frequency sample to be adjusted. One or more adjacent frequency samples may exist. If En is greater than the threshold thr[i], En is set to thr[i], that is, the amplitude of the spectral coefficient to be adjusted is set to thr[i]. The sign of the spectral coefficient to be adjusted is the sign of the BWE spectral coefficient of the frequency sample. A value obtained by multiplying the amplitude of the spectral coefficient to be adjusted by the sign of the spectral coefficient to be adjusted is used as an adjustment result of the frequency sample.

If the type of the current frame does not belong to the foregoing two types, the current frame has intermediate inter-frame correlation. If a spectral coefficient of a frequency sample is not decoded, a method for restoring the spectral coefficient to be adjusted of the frequency sample may be as follows: A weighted average value En of amplitude of a BWE spectral coefficient of the current frequency sample, amplitude of a BWE spectral coefficient of a frequency sample adjacent to the current frequency sample in the current frame, amplitude of a quantized spectral coefficient of a frequency sample corresponding to a frame previous to the current frame, and amplitude of a quantized spectral coefficient of an adjacent frequency sample of a frequency sample corresponding to the previous frame is calculated as the amplitude of spectral coefficient to be adjusted. Herein, the current frequency sample is a frequency sample having the spectral coefficient to be adjusted and may be called a frequency sample to be adjusted. The adjacent frequency sample may be a frequency sample in the same frame having a frequency higher or lower than that of the frequency sample to be adjusted. One or more adjacent frequency samples may exist. If En is greater than the threshold thr[i], En is set to thr[i], that is, the amplitude of the spectral coefficient to be adjusted is set to thr[i]. The sign of the spectral coefficient to be adjusted is the sign of the BWE spectral coefficient of the frequency sample. A value obtained by multiplying the amplitude of the spectral coefficient to be adjusted by the sign of the spectral coefficient to be adjusted is used as an adjustment result of the frequency sample.

For a zero point in the all-zero vector and a non-all-zero vector, weighting coefficients used during a weighting operation may be different, so as to control the degree of adjusting the spectral coefficient, so that an acoustic resolution of the quantized spectral coefficient is not influenced, and additional noise is not introduced either.

Embodiment 4

Figure 5:
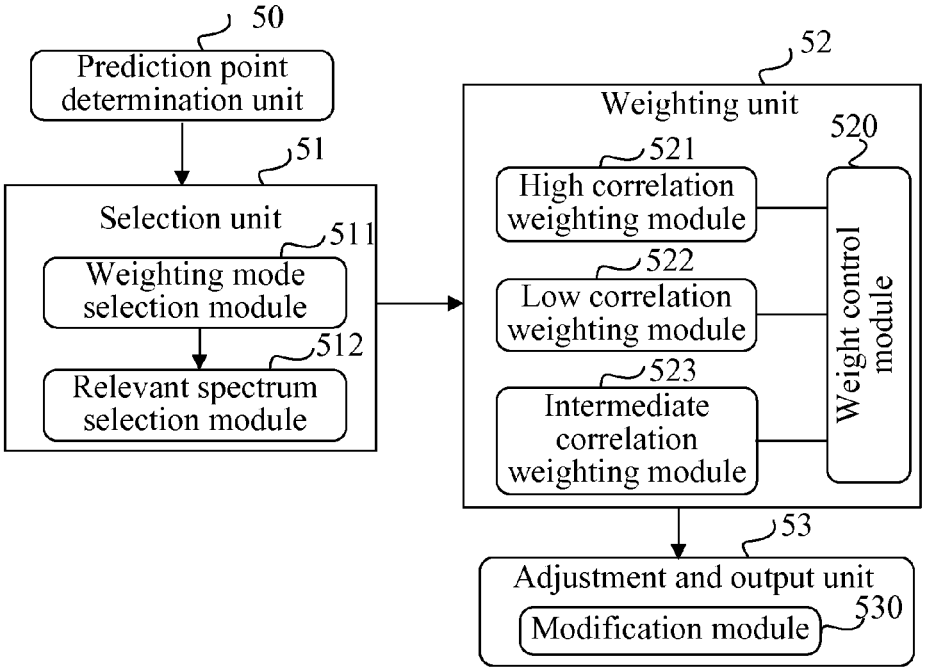
FIG. 5 is a schematic structural diagram of a signal de-noising apparatus according to Embodiment 4 of the present invention.

Based on the method embodiment, the present invention further provides an embodiment of a signal de-noising apparatus. Referring to FIG. 5, the apparatus includes:

- a selection unit 51, configured to select, according to a degree of inter-frame correlation of a frame where a spectral coefficient to be adjusted resides, at least two spectral coefficients having high correlation with a spectral coefficient to be adjusted;
- a weighting unit 52, configured to perform weighting on the at least two spectral coefficients selected by the selection unit 51 and the spectral coefficient to be adjusted to acquire a predicted value of the spectral coefficient to be adjusted, and
- an adjustment and output unit 53, configured to adjust a spectrum of a decoded signal by using the predicted value acquired by the weighting unit 52 and output the adjusted decoded signal.

Before the selection unit 51 selects, according to the degree of the inter-frame correlation of the frame where the spectral coefficient to be adjusted resides, the at least two spectral coefficients having the high correlation with the spectral coefficient to be adjusted, the spectral coefficient to be adjusted further needs to be determined according to quantization encoding precision of the spectral coefficient. Therefore, the apparatus further includes:

- a prediction point determination unit 50, configured to determine, according to quantization encoding precision of the spectral coefficient, the spectral coefficient to be adjusted, where the determined spectral coefficient to be adjusted includes an unquantized spectral coefficient and/or a spectral coefficient having quantization precision lower than a quantization precision threshold.

In one implementation mode, the selection unit 51 includes:

- a weighting mode selection module 511, configured to select, according to the degree of the inter-frame correlation of the frame where the spectral coefficient to be adjusted resides, one weighting mode from the three weighting modes: a high inter-frame correlation weighting mode, a low inter-frame correlation weighting mode, and an intermediate inter-frame correlation weighting mode; and
- a relevant spectrum selection module 512, configured to determine, according to the weighting mode selected by the weighting mode selection module 511, the at least two spectral coefficients having the high correlation with the spectral coefficient to be adjusted.

The weighting unit 52 includes any one of the following modules:

- a high correlation weighting module 521, configured to: for the high inter-frame correlation weighting mode, acquire the predicted value of the spectral coefficient to be adjusted according to a weighting value of at least one type of the following information: (1) a predicted value of a former frame, (2) a quantized spectral coefficient of the former frame; and (3) a BWE spectral coefficient of the former frame;
- a low correlation weighting module 522, configured to: for the low inter-frame correlation weighting mode, acquire the predicted value of the spectral coefficient to be adjusted according to a weighting value of at least one type of the following information: (1) a quantized spectral coefficient of a current frame, (2) a BWE spectral coefficient of the current frame; and (3) an existing predicted value of the current frame; and
- an intermediate correlation weighting module 523, configured to: for the intermediate inter-frame correlation weighting mode, acquire the predicted value of the spectral coefficient to be adjusted according to a weighting value of at least one type of the following information: (1) the predicted value of the former frame or the current frame, (2) the quantized spectral coefficient of the former frame or the current frame; and (3) the BWE spectral coefficient of the former frame or the current frame.

It should be noted that, the weights of the spectrum information used in the relevant weighting modes are controlled according to quantization precision of the spectral coefficient to be adjusted. The higher the quantization precision of the spectrum information is, the larger a corresponding weight of the spectrum information is. In addition, the weight is directly proportional to the quantization precision of the spectral coefficient. A product of the spectral coefficient and a weight corresponding to the spectral coefficient is a weighting value of the spectral coefficient.

Therefore, the weighting unit 52 further includes:

- a weight control module 520, configured to control the weight of the spectrum information according to the quantization precision of the spectral coefficient to be adjusted, where the higher the quantization precision of the spectrum information is, the larger the corresponding weight of the spectrum information is.

If energy of the spectral coefficient of the frequency sample after prediction is greater than an upper limit threshold of energy of the spectral coefficient to be adjusted, energy of the adjusted spectral coefficient needs to be controlled to be in a range less than or equal to the upper limit threshold. Therefore, the adjustment and output unit 53 further includes:

a modification module 530, configured to generate, according to the upper limit threshold of the energy of the spectral coefficient to be adjusted and the acquired predicted value, a modification value of the spectral coefficient to be adjusted, and adjust the spectrum of the decoded signal by using the modification value, where energy of the modification value of the spectral coefficient to be adjusted is less than or equal to the upper limit threshold of the energy of the spectral coefficient to be adjusted.

In the signal de-noising apparatus according to the embodiment of the present invention, the weighting unit weighs the spectral coefficient to be adjusted with the at least two relevant spectral coefficients selected by the selection unit to acquire the predicted value of the spectral coefficient to be adjusted, and the adjustment and output unit adjusts the spectrum of the decoded signal according to the predicted value of the spectral coefficient to be adjusted and then outputs the adjusted decoded signal, so that the predicted spectral coefficient (that is, the predicted value of the spectral coefficient to be adjusted) and other relevant spectral coefficients are adaptable to one another, and therefore the spectral coefficients obtained according to different quantization precision are adaptable to one another, thereby increasing smoothness of the spectrum of the decoded signal, reducing noise generated by frequency band synthesis after decoding, and enabling a band-synthesized audio signal to achieve a better acoustic effect.

Embodiment 5

Figure 6:
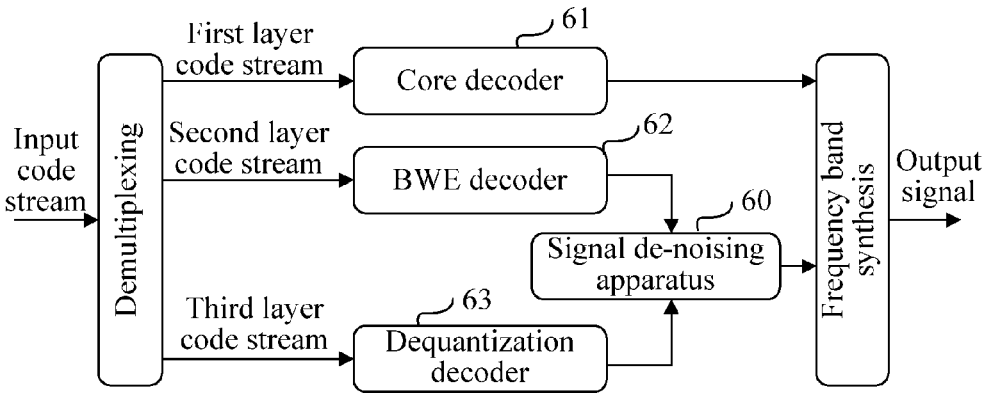
FIG. 6 is a structure diagram of an audio decoding system according to Embodiment 5 of the present invention.

Based on the apparatus embodiment, an embodiment of the present invention provides an audio decoding system. Referring to FIG. 6, the audio decoding system includes a core decoder 61, a BWE decoder 62, a dequantization decoder 63 and a signal de-noising apparatus 60. The core decoder 61 is configured to decode low-frequency information of a first layer code stream. The BWE decoder 62 is configured to decode BWE information of a second layer code stream. The dequantization decoder 63 is configured to decode and dequantize high-frequency band information of a third layer code stream of the remaining bits.

The signal de-noising apparatus 60 may be the signal de-noising apparatus according to the foregoing embodiment of the present invention, and is configured to receive the decoded information output by the BWE decoder and the dequantization decoder, determine, according to the decoded information of the second layer code stream and the third layer code stream, a spectral coefficient to be adjusted, and adjust the spectral coefficient in the decoded information of the third layer code stream according to an acquired predicted value of the spectral coefficient to be adjusted. More specifically, reference may be made to the foregoing apparatus embodiment, and the details are not described herein again.

It should be noted that, the methods of the embodiments of the present invention may also be implemented through the software functional module, and when the software functional module is sold or used as a separate product, the software functional module may also be stored in a computer readable storage medium. The storage medium mentioned may be a Read-Only Memory (ROM), a magnetic disk, or an optical disk.

Various functional units according to each embodiment of the present invention may be integrated in one processing module or exist as various separate physical units, or two or more units are integrated in one module. The integrated module may be implemented through hardware, or may also be implemented through a software functional module. When the integrated module is implemented through the software functional module and sold or used as a separate product, the integrated module may be stored in a computer readable storage medium. The storage medium mentioned may be a ROM, a magnetic disk, or an optical disk.

The foregoing embodiments are not intended to limit the present invention. For persons skilled in the art, any modification, equivalent replacement, and improvement made without departing from the principle of the present invention shall fall within the protection scope of the present invention.

What is claimed is:

1. An audio signal de-noising method, comprising:

selecting, according to inter-frame correlation of a frame in an audio signal where a spectral coefficient to be adjusted resides, at least two spectral coefficients having high correlation with the spectral coefficient to be adjusted;

performing weighting on the at least two selected spectral coefficients and the spectral coefficient to be adjusted to acquire a predicted value of the spectral coefficient to be adjusted; and adjusting a spectrum of a decoded signal by using the acquired predicted value, and outputting an adjusted decoded signal;

wherein the selecting at least two spectral coefficients further comprises:

selecting, according to the inter-frame correlation of the frame where the spectral coefficient to be adjusted resides, one weighting mode from the group of weighting modes consisting of: a high inter-frame correlation weighting mode, a low inter-frame correlation weighting mode, and an intermediate inter-frame correlation weighting mode, and determining, according to the selected weighting mode, the at least two spectral coefficients having high correlation with the spectral coefficient to be adjusted; and wherein during the performing weighting conditionally acquiring the predicted value of the spectral coefficient to be adjusted such that:

if the selected weighting mode is the high inter-frame correlation weighting mode, acquiring the predicted value of the spectral coefficient to be adjusted according to a weighting value of at least one type from the group consisting of: a predicted value of a former frame, a quantized spectral coefficient of the former frame; and a Band Width Extension (BWE) spectral coefficient of the former frame;

if the selected weighting mode is the low inter-frame correlation weighting mode, acquiring the predicted value of the spectral coefficient to be adjusted according to a weighting value of at least one type from the group consisting of: a quantized spectral coefficient of a current frame, a BWE spectral coefficient of the current frame; and an existing predicted value of the current frame; and if the selected weighting mode is the intermediate inter-frame correlation weighting mode, acquiring the predicted value of the spectral coefficient to be adjusted according to a weighting value of at least one type from the group consisting of: the predicted value of the former frame, the existing predicted value of the current frame, the quantized spectral coefficient of the former frame, the quantized spectral coefficient of the current frame, the BWE spectral coefficient of the former frame, and the BWE spectral coefficient of the current frame.

2. The method according to claim 1, wherein before the selecting step, the method comprises:

determining, according to quantization encoding precision of a spectral coefficient, the spectral coefficient to be adjusted, wherein the determined spectral coefficient to be adjusted includes at least one of the group consisting of: an unquantized spectral coefficient and a spectral coefficient having quantization precision lower than a quantization precision threshold.

3. The method according to claim 1, wherein the performing step further comprises:

controlling a weight of spectrum information according to quantization precision of the spectral coefficient to be adjusted, wherein higher quantization precision of the spectrum information corresponds to larger weight of the spectrum information.

4. The method according to claim 1, wherein if both the frame where the spectral coefficient to be adjusted resides and a previous frame of the frame where the spectral coefficient to be adjusted resides, are harmonic frames, then:

the frame where the spectral coefficient to be adjusted resides has high inter-frame correlation; and if an amplitude of a quantized spectral coefficient corresponding to a frame previous to the previous frame is greater than an amplitude of a quantized spectral coefficient corresponding to the previous frame by at least a specified number of times, amplitude of the spectral coefficient to be adjusted is a weighted sum of amplitude of a BWE spectral coefficient of the frame where the spectral coefficient to be adjusted resides and the amplitude of the quantized spectral coefficient corresponding to the previous frame, and a sign of the spectral coefficient to be adjusted is a sign of the BWE spectral coefficient of the frame where the spectral coefficient to be adjusted resides, and otherwise if the amplitude of the quantized spectral coefficient corresponding to the frame previous to the previous frame is not greater than the amplitude of the quantized spectral coefficient corresponding to the previous frame by at least the specified number of times, the amplitude of the spectral coefficient to be adjusted is a weighted sum of the amplitude of the quantized spectral coefficient corresponding to the frame previous to the previous frame, the amplitude of the quantized spectral coefficient corresponding to the previous frame, and the amplitude of the BWE spectral coefficient of the frame where the spectral coefficient to be adjusted resides, and the sign of the spectral coefficient to be adjusted is the sign of the BWE spectral coefficient of the frame where the spectral coefficient to be adjusted resides.

5. The method according to claim 1, wherein if the frame where the spectral coefficient to be adjusted resides or a previous frame of the frame where the spectral coefficient to be adjusted resides, is a transient frame, then:

the frame where the spectral coefficient to be adjusted resides has low inter-frame correlation, an amplitude of the spectral coefficient to be adjusted is a weighted average value of an amplitude of a BWE spectral coefficient of a frequency sample to be adjusted and an amplitude of a quantized spectral coefficient of an adjacent frequency sample; and if the weighted average value is greater than an upper limit threshold of the amplitude of the spectral coefficient to be adjusted, the amplitude of the spectral coefficient to be adjusted is set to the upper limit threshold, and a sign of the spectral coefficient to be adjusted is a sign of the BWE spectral coefficient of the frequency sample to be adjusted.

6. The method according to claim 1, wherein if it is a case not belonging to cases that both the frame where the spectral coefficient to be adjusted resides and a previous frame of the frame where the spectral coefficient to be adjusted resides, are harmonic frames and the frame where the spectral coefficient to be adjusted resides or the previous frame is a transient frame, then:

the frame where the spectral coefficient to be adjusted resides has intermediate inter-frame correlation, an amplitude of the spectral coefficient to be adjusted is a weighted average value of an amplitude of a BWE spectral coefficient of a frequency sample to be adjusted, an amplitude of a BWE spectral coefficient of an adjacent frequency sample of the frequency sample to be adjusted, an amplitude of a quantized spectral coefficient of a frequency sample corresponding to a previous frame of the frame having the frequency point to be adjusted, and an amplitude of a quantized spectral coefficient of an adjacent frequency sample of the frequency sample corresponding to the previous frame, and if the weighted average value is greater than an upper limit threshold of the amplitude of the spectral coefficient to be adjusted, then the amplitude of the spectral coefficient to be adjusted is set to the upper limit threshold, and a sign of the spectral coefficient to be adjusted is a sign of the BWE spectral coefficient of the frequency sample to be adjusted.

7. An audio signal de-noising method, comprising:

selecting, according to inter-frame correlation of a frame in an audio signal where a spectral coefficient to be adjusted resides, at least two spectral coefficients having high correlation with the spectral coefficient to be adjusted;

performing weighting on the at least two selected spectral coefficients and the spectral coefficient to be adjusted to acquire a predicted value of the spectral coefficient to be adjusted; and adjusting a spectrum of a decoded signal by using the acquired predicted value, and outputting an adjusted decoded signal;

wherein, if both the frame where the spectral coefficient to be adjusted resides and a previous frame of the frame where the spectral coefficient to be adjusted resides, are harmonic frames, then:

the frame where the spectral coefficient to be adjusted resides has high inter-frame correlation; and if an amplitude of a quantized spectral coefficient corresponding to a frame previous to the previous frame is greater than an amplitude of a quantized spectral coefficient corresponding to the previous frame by at least a specified number of times, an amplitude of the spectral coefficient to be adjusted is a weighted sum of an amplitude of a BWE spectral coefficient of the frame where the spectral coefficient to be adjusted resides and the amplitude of the quantized spectral coefficient corresponding to the previous frame, and a sign of the spectral coefficient to be adjusted is a sign of the BWE spectral coefficient of the frame where the spectral coefficient to be adjusted resides, and otherwise if the amplitude of the quantized spectral coefficient corresponding to the frame previous to the previous frame is not greater than the amplitude of the quantized spectral coefficient corresponding to the previous frame by at least the specified number of times, the amplitude of the spectral coefficient to be adjusted is a weighted sum of the amplitude of the quantized spectral coefficient corresponding to the frame previous to the previous frame, the amplitude of the quantized spectral coefficient corresponding to the previous frame, and the amplitude of the BWE spectral coefficient of the frame where the spectral coefficient to be adjusted resides, and the sign of the spectral coefficient to be adjusted is the sign of the BWE spectral coefficient of the frame where the spectral coefficient to be adjusted resides.

8. An audio signal de-noising method, comprising:

selecting, according to inter-frame correlation of a frame in an audio signal where a spectral coefficient to be adjusted resides, at least two spectral coefficients having high correlation with the spectral coefficient to be adjusted;

performing weighting on the at least two selected spectral coefficients and the spectral coefficient to be adjusted to acquire a predicted value of the spectral coefficient to be adjusted; and adjusting a spectrum of a decoded signal by using the predicted value, and outputting an adjusted decoded signal;

wherein, if the frame where the spectral coefficient to be adjusted resides or a previous frame of the frame where the spectral coefficient to be adjusted resides, is a transient frame, then:

the frame where the spectral coefficient to be adjusted resides has low inter-frame correlation;

an amplitude of the spectral coefficient to be adjusted is a weighted average value of an amplitude of a BWE spectral coefficient of a frequency sample to be adjusted and an amplitude of a quantized spectral coefficient of an adjacent frequency sample; and if the weighted average value is greater than an upper limit threshold of the amplitude of the spectral coefficient to be adjusted, then the amplitude of the spectral coefficient to be adjusted is set to the upper limit threshold; and a sign of the spectral coefficient to be adjusted is a sign of the BWE spectral coefficient of the frequency sample to be adjusted.

9. An audio signal de-noising method, comprising:

selecting, according to inter-frame correlation of a frame in an audio signal where a spectral coefficient to be adjusted resides, at least two spectral coefficients having high correlation with the spectral coefficient to be adjusted;

performing weighting on the at least two selected spectral coefficients and the spectral coefficient to be adjusted to acquire a predicted value of the spectral coefficient to be adjusted; and adjusting a spectrum of a decoded signal by using the acquired predicted value, and outputting an adjusted decoded signal;

wherein, if it is a case not belonging to cases that:

both the frame where the spectral coefficient to be adjusted resides and a previous frame of the frame where the spectral coefficient to be adjusted resides are harmonic frames and the frame where the spectral coefficient to be adjusted resides or the previous frame is a transient frame, then:

the frame where the spectral coefficient to be adjusted resides has intermediate inter-frame correlation;

an amplitude of the spectral coefficient to be adjusted is a weighted average value of an amplitude of a BWE spectral coefficient of a frequency sample to be adjusted, an amplitude of a BWE spectral coefficient of an adjacent frequency sample of the frequency sample to be adjusted, an amplitude of a quantized spectral coefficient of a frequency sample corresponding to a previous frame of the frame having the frequency point to be adjusted, and an amplitude of a quantized spectral coefficient of an adjacent frequency sample of the frequency sample corresponding to the previous frame; and if the weighted average value is greater than an upper limit threshold of the amplitude of the spectral coefficient to be adjusted, then the amplitude of the spectral coefficient to be adjusted is set to the upper limit threshold; and a sign of the spectral coefficient to be adjusted is a sign of the BWE spectral coefficient of the frequency sample to be adjusted.

10. An audio signal de-noising apparatus, comprising:

a selection unit, configured to select, according to inter-frame correlation of a frame in an audio signal where a spectral coefficient to be adjusted resides, at least two spectral coefficients having high correlation with the spectral coefficient to be adjusted;

a weighting unit, configured to perform weighting on the at least two spectral coefficients selected by the selection unit and the spectral coefficient to be adjusted to acquire a predicted value of the spectral coefficient to be adjusted; and an adjustment and output unit, configured to adjust a spectrum of a decoded signal by using the predicted value acquired by the weighting unit and output an adjusted decoded signal;

wherein the selection unit comprises:

a weighting mode selection module, configured to select, according to the inter-frame correlation of the frame where the spectral coefficient to be adjusted resides, one weighting mode from a group of weighting modes including:

a high inter-frame correlation weighting mode, a low inter-frame correlation weighting mode, and an intermediate inter-frame correlation weighting mode; and a relevant spectrum selection module, configured to determine, according to the weighting mode selected by the weighting mode selection module, the at least two spectral coefficients having the high correlation with the spectral coefficient to be adjusted; and wherein the weighting unit comprises:

a high correlation weighting module, configured for the high inter-frame correlation weighting mode to: acquire the predicted value of the spectral coefficient to be adjusted according to a weighting value of at least one type from the group consisting of: (1) a predicted value of a former frame, (2) a quantized spectral coefficient of the former frame; and (3) a Band Width Extension (BWE) spectral coefficient of the former frame;

a low correlation weighting module, configured for the low inter-frame correlation weighting mode to: acquire the predicted value of the spectral coefficient to be adjusted according to a weighting value of at least one type from the group consisting of: (1) a quantized spectral coefficient of a current frame, (2) a BWE spectral coefficient of the current frame; and (3) an existing predicted value of the current frame; and an intermediate correlation weighting module, configured for the intermediate inter-frame correlation weighting mode to: acquire the predicted value of the spectral coefficient to be adjusted according to a weighting value of at least one type from the group consisting of: (1) the predicted value of the former frame, (2) the existing predicted value of the current frame, (3) the quantized spectral coefficient of the former frame, (4) the quantized spectral coefficient of the current frame, (5) the BWE spectral coefficient of the former frame, and (6) the BWE spectral coefficient of the current frame.

11. The apparatus according to claim 10, further comprising:

a prediction point determination unit, configured to determine, according to a quantization encoding precision of the spectral coefficient, the spectral coefficient to be adjusted, wherein the determined spectral coefficient to be adjusted comprises at least one of the group consisting of: an unquantized spectral coefficient, and a spectral coefficient having a quantization precision lower than a quantization precision threshold.

12. The apparatus according to claim 10, wherein the weighting unit further comprises:

a weight control module, configured to control a weight of spectrum information according to quantization precision of the spectral coefficient to be adjusted, wherein the higher the quantization precision of the spectrum information is, the larger a corresponding weight of the spectrum information is.

13. An audio signal decoding system, comprising a core decoder, a Band Width Extension (BWE) decoder, a dequantization decoder, and an audio signal de-noising apparatus, wherein the core decoder is configured to decode low-frequency information of a first layer code stream;

the BWE decoder is configured to decode BWE information of a second layer code stream;

the dequantization decoder is configured to decode and dequantize high-frequency band information of a third layer code stream of remaining bits; and the audio signal de-noising apparatus is configured to receive the decoded information output by the BWE decoder and the dequantization decoder, determine a spectral coefficient to be adjusted in the decoded information, and adjust a spectral coefficient in the decoded information according to an acquired predicted value of the spectral coefficient to be adjusted;

wherein the audio signal de-noising apparatus comprises:

a selection unit, configured to select, according to inter-frame correlation of a frame in an audio signal where a spectral coefficient to be adjusted resides, at least two spectral coefficients having high correlation with the spectral coefficient to be adjusted;

a weighting unit, configured to perform weighting on the at least two spectral coefficients selected by the selection unit and the spectral coefficient to be adjusted to acquire a predicted value of the spectral coefficient to be adjusted; and an adjustment and output unit, configured to adjust a spectrum of a decoded signal by using the predicted value acquired by the weighting unit and output an adjusted decoded signal;

wherein the selection unit further comprises:

a weighting mode selection module, configured to select, according to the inter-frame correlation of the frame in an audio signal where the spectral coefficient to be adjusted resides, one weighting mode from a group of weighting modes including:

a high inter-frame correlation weighting mode, a low inter-frame correlation weighting mode, and an intermediate inter-frame correlation weighting mode; and a relevant spectrum selection module, configured to determine, according to the weighting mode selected by the weighting mode selection module, the at least two spectral coefficients having the high correlation with the spectral coefficient to be adjusted;

wherein the weighting unit further comprises:

a high correlation weighting module, configured for the high inter-frame correlation weighting mode to acquire the predicted value of the spectral coefficient to be adjusted according to a weighting value of at least one type from the group consisting of: (1) a predicted value of a former frame, (2) a quantized spectral coefficient of the former frame; and (3) a Band Width Extension (BWE) spectral coefficient of the former frame;

a low correlation weighting module, configured for the low inter-frame correlation weighting mode to acquire the predicted value of the spectral coefficient to be adjusted according to a weighting value of at least one type from the group consisting of: (1) a quantized spectral coefficient of a current frame, (2) a BWE spectral coefficient of the current frame; and (3) an existing predicted value of the current frame; and an intermediate correlation weighting module, configured for the intermediate inter-frame correlation weighting mode to acquire the predicted value of the spectral coefficient to be adjusted according to a weighting value of at least one type from the group consisting of: (1) the predicted value of the former frame, (2) the existing predicted value of the current frame, (3) the quantized spectral coefficient of the former frame, (4) the quantized spectral coefficient of the current frame, (5) the BWE spectral coefficient of the former frame, and (6) the BWE spectral coefficient of the current frame.

14. A non-transitory computer-readable medium having computer usable instructions stored thereon for execution by a processor to perform a signal de-noising method, wherein the method comprises:

selecting, according to inter-frame correlation of a frame where a spectral coefficient to be adjusted resides, at least two spectral coefficients having high correlation with the spectral coefficient to be adjusted;

performing weighting on the at least two selected spectral coefficients and the spectral coefficient to be adjusted to acquire a predicted value of the spectral coefficient to be adjusted; and adjusting a spectrum of a decoded signal by using the acquired predicted value, and outputting an adjusted decoded signal;

wherein the selecting at least two spectral coefficients further comprises:

selecting, according to the inter-frame correlation of the frame in an audio signal where the spectral coefficient to be adjusted resides, one weighting mode from the group of weighting modes consisting of: a high inter-frame correlation weighting mode, a low inter-frame correlation weighting mode, and an intermediate inter-frame correlation weighting mode, and determining, according to the selected weighting mode, the at least two spectral coefficients having high correlation with the spectral coefficient to be adjusted; and wherein during the performing weighting conditionally acquiring the predicted value of the spectral coefficient to be adjusted such that:

if the selected weighting mode is the high inter-frame correlation weighting mode, acquiring the predicted value of the spectral coefficient to be adjusted according to a weighting value of at least one type from the group consisting of: a predicted value of a former frame, a quantized spectral coefficient of the former frame; and a Band Width Extension (BWE) spectral coefficient of the former frame;

if the selected weighting mode is the low inter-frame correlation weighting mode, acquiring the predicted value of the spectral coefficient to be adjusted according to a weighting value of at least one type from the group consisting of: a quantized spectral coefficient of a current frame, a BWE spectral coefficient of the current frame; and an existing predicted value of the current frame; and if the selected weighting mode is the intermediate inter-frame correlation weighting mode, acquiring the predicted value of the spectral coefficient to be adjusted according to a weighting value of at least one type from the group consisting of: the predicted value of the former frame, the existing predicted value of the current frame, the quantized spectral coefficient of the former frame, the quantized spectral coefficient of the current frame, the BWE spectral coefficient of the former frame, and the BWE spectral coefficient of the current frame.

* * * * *